US006050007A

United States Patent [19]

Angelieri et al.

[11] Patent Number: 6,050,007

[45] Date of Patent: Apr. 18, 2000

[54] LIGHTED ATHLETIC SHOE METHOD AND APPARATUS

[76] Inventors: Robert S. Angelieri, 133 Hibiscus Ct.; Brian Zoghbi, 4868 Cypress Woods Dr., Apt. #112, both of Orlando, Fla. 32801

[21] Appl. No.: 09/309,860

[22] Filed: May 11, 1999

[51] Int. Cl.[7] ..... A43B 23/00

[52] U.S. Cl. ..... 36/137

[58] Field of Search ..... 36/136, 137

[56] References Cited

U.S. PATENT DOCUMENTS

| | | |
|---|---|---|
| 4,158,922 | 6/1979 | Dana, III . |
| 4,712,319 | 12/1987 | Goria . |
| 5,052,131 | 10/1991 | Rondini . |
| 5,177,812 | 1/1993 | DeMars . |
| 5,303,131 | 4/1994 | Wu . |
| 5,477,435 | 12/1995 | Rapisarda et al. . |
| 5,490,338 | 2/1996 | Hwang et al. . |
| 5,584,132 | 12/1996 | Weaver et al. . |
| 5,692,324 | 12/1997 | Goldston et al. . |
| 5,704,706 | 1/1998 | Goldston et al. . |
| 5,720,121 | 2/1998 | Barker . |
| 5,746,499 | 5/1998 | Ratcliffe et al. . |
| 5,839,211 | 11/1998 | Pallera . |
| 5,955,957 | 9/1999 | Calabrese et al. . |

FOREIGN PATENT DOCUMENTS

| | | |
|---|---|---|
| 534560 | 3/1993 | European Pat. Off. . |

*Primary Examiner*—Ted Kavanaugh
*Attorney, Agent, or Firm*—William M. Hobby, III

[57] ABSTRACT

A method of lighting an athletic shoe includes selecting an athletic shoe having an upper having a sole attached thereto forming a bore in the sole and selecting a bore cover for covering the bore. The method includes activating a tubular chemiluminescent light source, inserting the activated light source into the athletic shoe sole bore, and attaching the bore cover for lighting a shoe sole of an athletic shoe. A selected athletic shoe has a transparent or translucent sole having a bore extending at least half the length of the sole. The athletic shoe apparatus includes an upper having a partially transparent sole attached thereto having a bore extending into the sole at least half the length of the sole and having grooves formed on one end thereof and an activated chemiluminescent tube removably inserted into the sole bore and the sole bore cover attached with bayonet connector tabs into the grooves formed on one end of the sole bore.

9 Claims, 2 Drawing Sheets

LIGHTED ATHLETIC SHOE METHOD AND APPARATUS

BACKGROUND OF THE INVENTION

The present invention relates to a method of lighting an athletic shoe and to a lighted athletic shoe apparatus and especially to a lighted athletic shoe having an activated chemiluminescent light source removably attached into the sole of the shoe.

There have been a variety of prior art lighted shoes including fashion shoes having a twinkling effect or shoes for use in dancing or exercise or to improve the safety of the wearer. A common lighting technique provides lights and lighting circuits, especially LED's, positioned within the soles or heels of the shoes. The lighting circuits can provide a twinkling effect or a continuous light source. The lighting circuits typically include a battery connected to an LED or other light source and an electric circuit and a switch for the light.

Typical prior art lighted shoes having a light mounted in shoe heels includes the Goldston et al. U.S. Pat. No. 5,692,324 and U.S. Pat. No. 5,704,706, for an athletic shoe which incorporates a releasably locking plug-in module removably inserted into a recessed retaining receptacle in the sole of the shoe. The plug-in module includes a battery and an external visible light emitting device along with a switch for energizing the light emitting device in response to pressure exerted upon it by the foot of the wearer during walking or running.

The Hwang et al. U.S. Pat. No. 5,490,338, is a fixing structure for a lightening circuit on a lighted shoe for receiving and protecting a lighting circuit within the shoe and allows the lighting circuit to be taken out for examining and repairing the circuit as well as for replacement of the batteries. The Rapisarda et al. U.S. Pat. No. 5,477,435, is a module to provide intermittent light with movement of the shoe. The module has an LED extending out the rear thereof for providing a light on the rear of the heel of the shoe and is especially made for gym shoes.

Other prior art patents that have lights or reflectors attached to a shoe include the Weaver et al. U.S. Pat. No. 5,584,132, which is for a shoelace tip holder which attaches to the tips of shoelaces for holding a decorative article therein including a chemiluminescent light source which glows in the dark. The Pallera U.S. Pat. No. 5,839,211, is for a shoe having a display assembly including an outer translucent member attached to the side of the shoe to form a sealed compartment for holding a decorative element. The Goria U.S. Pat. No. 4,712,319, is footwear having elastomeric or plastomeric soles having decorating elements attached thereto.

In contrast to these prior patents, the present invention is for a method of lighting an athletic shoe for a short period of time by utilizing a chemiluminescent tube, such as a day-glow tube, which has been activated and then attached to the shoe. The shoes having the present invention incorporated are especially desirable for dancing when dancing is performed with athletic shoes but may also be advantageously used by walkers or joggers at night as a safety feature providing lighted sole athletic shoes which can be easily distinguished by the driver of a vehicle. Such shoes with a light source, in accordance with the present invention, are much more clearly visible to the human eye than an LED mounted within a shoe in accordance with prior art lighted shoes.

SUMMARY OF THE INVENTION

A method of lighting an athletic shoe includes selecting an athletic shoe having an upper having a sole attached thereto forming a bore in the sole and selecting a bore cover for covering the bore. The method includes activating a tubular chemiluminescent light source, inserting the activated light source into the athletic shoe sole bore, and attaching the bore cover for lighting a shoe sole of an athletic shoe. The selected athletic shoe has a transparent or translucent sole having a bore extending at least half the length of the sole. The athletic shoe apparatus includes an upper having a partially transparent sole attached thereto having a bore extending into the sole at least half the length of the sole and has grooves formed on one end thereof and an activated chemiluminescent tube removably inserted into the sole bore with the sole bore cover attached with bayonet connector tabs into the grooves formed on one end of the sole bore.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figures 1, 2, 3, 4:
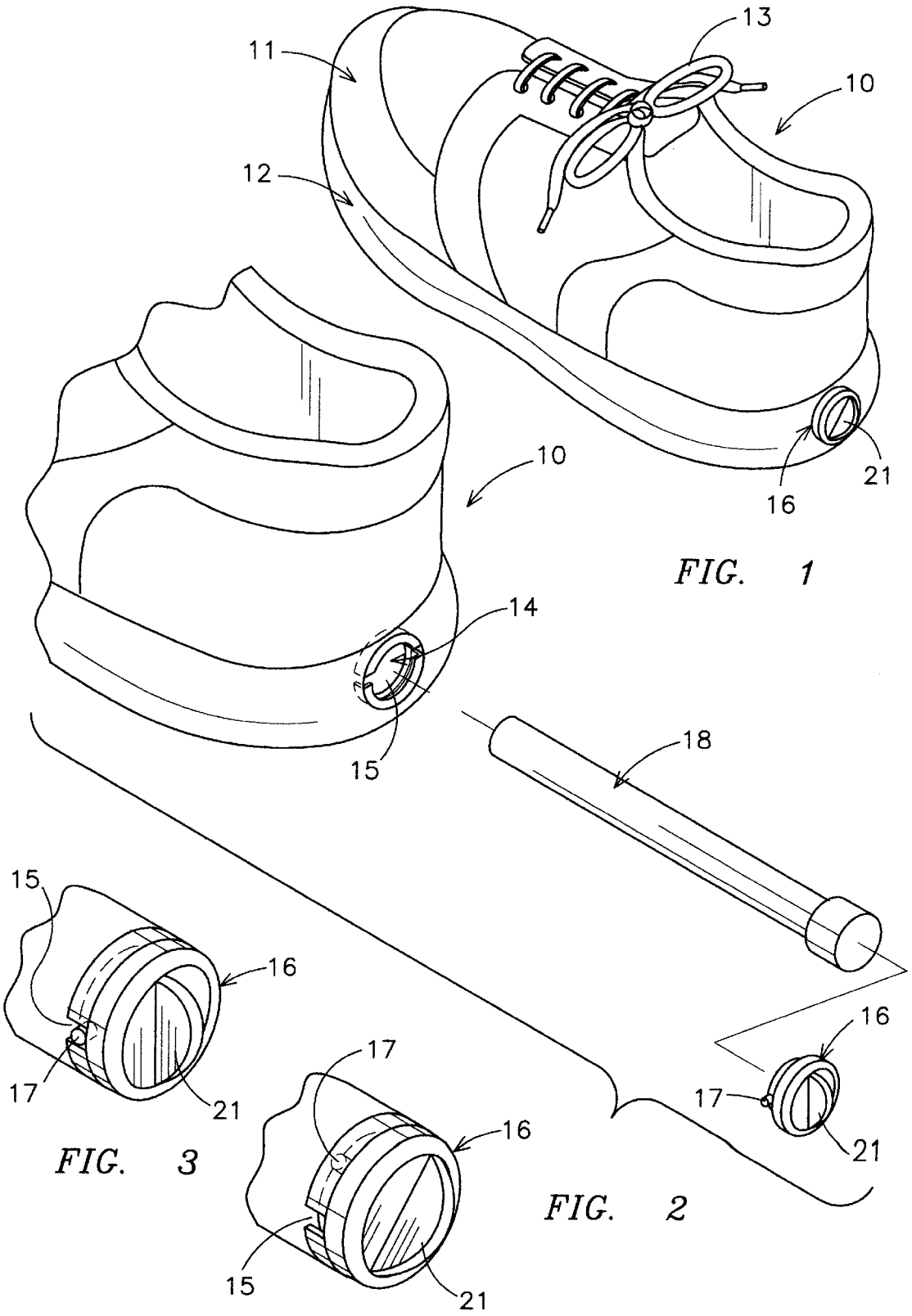
FIG. 1 is a perspective view of an athletic shoe incorporating the present invention.
FIG. 2 is an exploded view of a portion of the athletic shoe of FIG. 1 having the light source removed.
FIG. 3 is a perspective view of a bore cover for the shoe of FIGS. 1 and 2.
FIG. 4 is a perspective view of a bore cover in accordance with FIG. 3 in a locked position.
Figure 5:
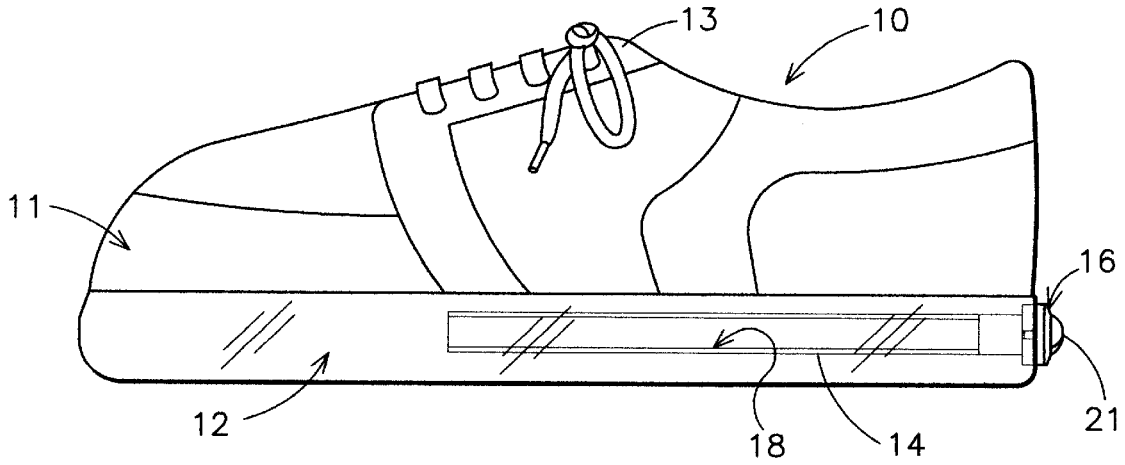
FIG. 5 is a side elevation of the lighted shoe of FIGS. 1 and 2.
Figure 6:
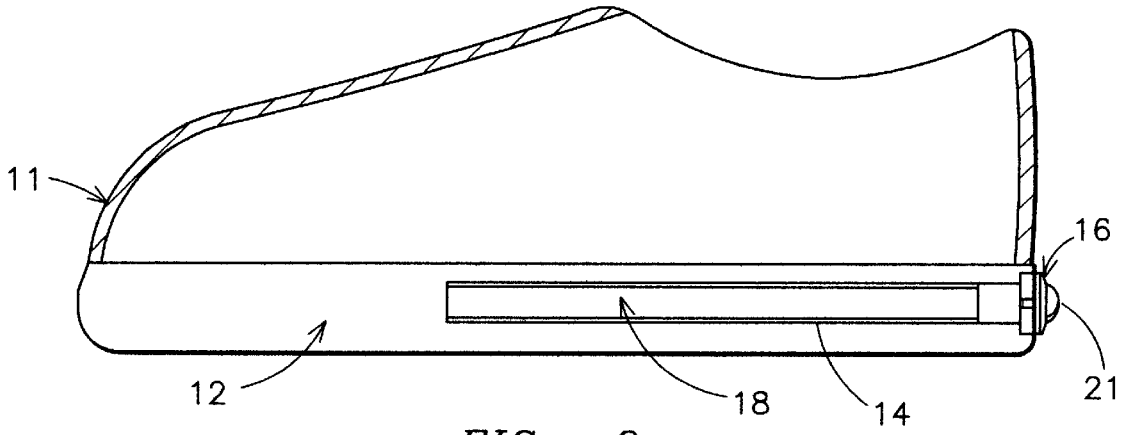
FIG. 6 is a sectional view taken through the shoe of FIG. 5.

Referring to FIGS. 1 through 6 of the drawings, an athletic shoe 10 in accordance with the present invention has uppers 11 and a polymer sole 12 mounted thereon. The upper 11 has shoelaces 13 for tieing the shoe. The sole 12 has an elongated bore 14 formed within the sole. The bore end has grooves 15 for accepting a cover 16 having tabs 17 thereon which lock into the grooves, as illustrated in FIGS. 3 and 4. A chemiluminescent tube 18, such as a day-glow tube, is removably inserted into the bore 14, as seen in FIGS. 5 and 6. The bore 14, as seen in FIGS. 5 and 6, extends more than half the length of a generally transparent shoe sole 12. The chemiluminescent light source is activated by properly bending the tube 18 or otherwise mixing two or more chemical elements in the tube at which time the tube continues to glow as long as the chemical reaction is taking place. This might typically last for several hours. By having the chemiluminescent tube activated within the shoe sole 12, the entire sole is lighted up with different colors depending on the color of the chemiluminescent tube. The tube glows brightly in the dark drawing attention to the shoes as well as to the person wearing the shoes. The chemiluminescent tube is generally tubular or cylindrical in shape and may have a sealed cover on one end thereof and is sized slightly smaller than the bore 14 so that it can be easily inserted and removed. It is held in place by the cover 16. Thus, an activated tube 18 can be inserted into the bore and the cover 16 attached using the handle portion 21 and the bayonet connection to seal the activated chemiluminescent tube 18 in the sole 12 which will then provide a glowing shoe sole until the chemiluminescent tube 18 completes the chemical reaction and ceases to glow, at which time the cover 16 can be removed and the tube 18 removed from the sole 12 of the shoe 10.

Figure 7:
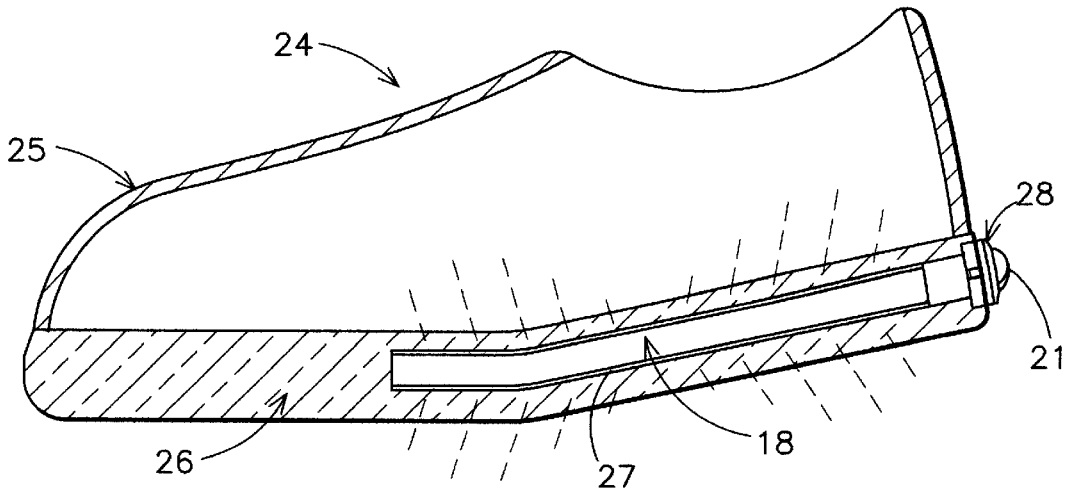
FIG. 7 is a sectional view of an alternate embodiment of the lighted shoe of FIGS. 5 and 6 having a sole made with a translucent material.

FIG. 7 shows an alternate embodiment of a shoe 24 having an upper 25 and a translucent sole 26 attached to the upper 25. The translucent sole 26 has a bore 27 extending therein with a cover 28. The chemiluminescent tube 18 has been inserted for producing the glowing light in the dark which is dispersed with the translucent sole 26 to provide a glowing type sole on an athletic shoe.

The method of the present invention includes the selecting of a shoe 10 or 24 and forming a bore 14 or 27 therein greater than half the length of the sole 12 or 26. The cover 16 or 28 is then attached and the chemiluminescent tube 18 is selected to fit the bore 27 for approximately the same length as the bore 14 or 27 and then activating the chemiluminescent source prior to inserting the tube into the sole bore. The lighted tube is then inserted into the sole bore 14 or 27 and the cover 16 or 28 attached to the end. The chemiluminescent source 18 is activated just prior to a person using the shoes in some activity. Once the source is used up, it is discarded.

It should be clear at this time that a method and apparatus for lighting a shoe sole has been provided which utilizes a chemiluminescent light source with an athletic shoe sole made of a translucent or transparent material. The light source is removably attached to the sole with a removably attaching cover. However, the present invention should not be considered as limited to the forms shown which should be considered illustrative rather than restrictive.

I claim:

1. A method of lighting an athletic shoe comprising the steps of:

selecting an athletic shoe having an upper having a sole attached thereto;

forming a bore in said sole of said selected athletic shoe;

selecting a bore cover;

activated a generally tubular chemiluminescent light source;

inserting said activated chemiluminescent light source into said athletic shoe sole bore; and attaching said bore cover over said bore to removably hold aid chemiluminescent light source in said sole bore, thereby lighting a shoe sole of an athletic shoe.

2. A method of lighting an athletic shoe in accordance with claim 1 in which the step of selecting an athletic shoe includes selecting an athletic shoe having a translucent sole for dispersing light from said chemiluminescent light source.

3. A method of lighting an athletic shoe in accordance with claim 2 in which the step of selecting an athletic shoe includes selecting forming a bore in said sole includes forming a bore with grooves therein for attaching said cover to said shoe sole.

4. A method of lighting an athletic shoe in accordance with claim 3 in which the step of selecting an bore cover includes selecting a bore cover having a bayonet tabs for locking into said grooves formed in said bore of said shoe sole.

5. A method of lighting an athletic shoe in accordance with claim 2 in which the step of selecting a cover includes selecting a cover having a handle member formed thereon.

6. A method of lighting an athletic shoe in accordance with claim 1 in which the step of activating said chemiluminescent light source includes bending a polymer tube to release two chemicals together within said polymer tube.

7. A method of lighting an athletic shoe in accordance with claim 1 in which the step of selecting an athletic shoe includes selecting an athletic shoe having a generally transparent sole.

8. A method of lighting an athletic shoe in accordance with claim 1 in which the step of forming a bore in the sole of said athletic shoe includes forming a bore extending more than half the length of the sole of said athletic shoe.

9. An athletic shoe comprising:

an upper;

a partially transparent sole attached to said upper, said sole having a bore therein extending at least half the length of said sole and having grooves formed on one end thereof;

an activated chemiluminescent tube removably inserted into said sole bore; and a sole bore cover having a bayonet connector tabs thereon for engaging said grooves formed on one end of said sole bore, whereby an athletic shoe sole may be illuminated.

* * * * *